United States Patent [19]

Kishida et al.

[11] Patent Number: 4,814,264

[45] Date of Patent: Mar. 21, 1989

[54] SILVER HALIDE PHOTOGRAPHIC MATERIAL AND METHOD FOR PREPARATION THEREOF

[75] Inventors: Seiichiro Kishida; Minoru Sato, both of Kanagawa, Japan

[73] Assignee: Fuji Photo Film Co., Ltd., Kanagawa, Japan

[21] Appl. No.: 133,974

[22] Filed: Dec. 17, 1987

[30] Foreign Application Priority Data

Dec. 17, 1986 [JP] Japan ..... 61-300410

[51] Int. Cl.[4] ..... G03C 1/02; G03C 1/06; G03C 1/12

[52] U.S. Cl. ..... 430/567; 430/502; 430/569; 430/570; 430/577; 430/581; 430/582; 430/583; 430/584; 430/585; 430/586; 430/587; 430/590; 430/591; 430/592; 430/599; 430/603

[58] Field of Search ..... 430/502, 567, 569, 570, 430/577, 581, 582, 583, 584, 585, 586, 587, 590, 591, 592, 599, 603

[56] References Cited

U.S. PATENT DOCUMENTS

| | | | |
|---|---|---|---|
| 4,386,156 | 3/1983 | Mignot | 430/567 |
| 4,414,310 | 11/1983 | Daubendiek et al. | 430/569 |
| 4,433,048 | 2/1984 | Solberg et al. | 430/569 |
| 4,434,226 | 2/1984 | Wilgus et al. | 430/569 |
| 4,435,501 | 3/1984 | Maskasky | 430/434 |
| 4,439,520 | 3/1984 | Kofron et al. | 430/495 |
| 4,585,729 | 4/1986 | Sugimoto et al. | 430/495 |
| 4,735,894 | 4/1988 | Ogawa | 430/567 |
| 4,758,504 | 7/1988 | Ohya et al. | 430/569 |
| 4,769,315 | 9/1988 | Suda et al. | 430/567 |

*Primary Examiner*—Mukund J. Shah

*Attorney, Agent, or Firm*—Sughrue, Mion, Zinn, Macpeak & Seas

[57] ABSTRACT

A silver halide light-sensitive material is disclosed, comprising a support having thereon at least one light-sensitive silver halide emulsion layer comprising silver halide grains and a binder, at least about 50 wt % of said silver halide grains comprising a silver halide grain matrix having thereon from about 10 to 10,000 protrusions per square micrometer of grain matrix surface, said individual protrusions having an average projected area diameter of up to about 0.15 μm, and a halogen composition of said protrusions differing from that of the grain matrix; said silver halide emulsion being chemically sensitized with at least one compound selected from the group consisting of a sulfur compound, a selenium compound, a reducing compound and a noble metal compound; and said silver halide emulsion being spectrally sensitized with a methine dye.

A method for preparing a silver halide light-sensitive material comprising a support having thereon at least one light-sensitive silver halide emulsion layer comprising the steps of:

(a) preparing an emulsion comprising a silver halide grain matrix;

(b) forming protrusions on said silver halide grain matrix at a silver electric potential of at least about +110 mV, at least about 50 wt % of said silver halide grain matrix having thereon from about 10 to 10,000 protrusions per square micrometer of grain matrix surface, said individual protrusions having an average projected area diameter of up to about 0.15 μm, and a halogen composition of said protrusions having a halogen composition differing from that of said grain matrix;

(c) stabilizing the grains obtained in step (b) with a grain formation-stopping agent; and (d) then chemically sensitizing said stabilized grains.

27 Claims, 4 Drawing Sheets

SILVER HALIDE PHOTOGRAPHIC MATERIAL AND METHOD FOR PREPARATION THEREOF

FIELD OF THE INVENTION

The present invention relates to silver halide photographic materials and a method for preparation thereof. More particularly it is concerned with the silver halide photographic materials containing silver halide grains with an increased specific surface area, which are suitable for spectral sensitization, and a method for their preparation.

BACKGROUND OF THE INVENTION

Spectral sensitization is an important and essential technique for production of light-sensitive materials having high sensitivity and excellent color reproduction. To provide light-sensitive materials of high sensitivity, various spectral sensitizers have been developed, as well as techniques such as supersensitization and an adding method thereof. Spectral sensitizers act to absorb light in the long wavelength region to which an unsensitized silver halide photographic emulsion does not substantially absorbes and to transmit the light absorbing electron and/or light absorbing energy to the silver halide. The increase of the light captured through such spectral sensitizers advantageously contributes to an increase of photographic sensitivity. For this reason, it is desired to develop spectral sensitizers having a high coefficient of light absorbance and to increase the amount of light captured by increasing the amount of the spectral sensitizers added to a silver halide emulsion.

Attempts have been made to develop a method for adding increased amounts of spectral sensitizers and also a method for preparation of improved silver halide emulsions.

For example, Thomas L. Penner and P. B. Gilman, Jr., *Photographic Science and Engineering,* Vol. 20 (3), pp. 97–106 (1976) disclose a method in which a large amount of two types of spectral sensitizers having a suitable electric potential relationship is adsorbed in a laminated form onto silver halide crystals, thereby increasing the amount of light captured by the spectral sensitizers and also preventing desensitization due to the addition of a large amount of the spectral sensitizers.

In addition, methods to improve silver halide grains themselves have been attempted. One of the methods is to use tabular silver halide grains having an increased specific surface area, as described in Japanese patent application (OPI) Nos. 113926/83, 113927/83, 113926/83, 113930/83, 113934/83, 111934/83, 95337/83, 108528/83, 108526/83, (the term "OPI" as used herein means a "published unexamined Japanese patent application").

C. R. Berry and D. C. Skillman, *J. Appl. Phys.,* Vol. 35, pp. 2165–2169 (1964) disclose silver halide grains in which AgCl is epitaxially grown on the silver bromide grain surface by adding an equal atomic equivalent of a KCl solution to an aqueous suspension of AgBr crystals and then adding thereto a somewhat smaller amount of a $AgNO_3$ solution. Japanese patent application (OPI) No. 133540/84 discloses grains in which AgCl is epitaxially grown non-selectively on the silver bromide grain surface by double jet addition at 40° C. and a pAg of 7.2.

Although the above grains do not have an increased specific surface area, the specific surface area can be increased by the method of preparation of the grains.

In all of the above grains, however, the size of a protrusion epitaxially grown on the grain surface is large and/or the number of protrusions per unit area is small. With these grains, therefore, the specific surface area cannot be sufficiently increased in comparison with grains of equal size without protrusions.

Although small protrusions are advantageous with respect to specific surface area, they are quite difficult to prepare in a stabilized manner. In practice, therefore, such grains having a structure suitable for chemical sensitization have not been produced.

SUMMARY OF THE INVENTION

One object of the present invention is to provide a silver halide photographic material using an emulsion containing silver halide grains having a large specific surface area which are suitable for spectral sensitization.

Another object of the present invention is to provide a method for preparing a silver halide photographic material using an emulsion containing silver halide grains having a large specific surface area which are suitable for spectral sensitization.

It has now been found that these and other objects of the present invention are attained by a silver halide light-sensitive material comprising a support having thereon at least one light-sensitive silver halide emulsion layer comprising silver halide grains and a binder, at least about 50 wt% of said silver halide grains comprising a grain matrix having thereon from about 10 to 10,000 protrusions per square micrometer of grain matrix surface, said individual protrusions having an average projected area diameter of up to about 0.15 μm, and a halogen composition of said protrusions differing from that of the grain matrix; said silver halide emulsion being chemically sensitized with at least one compound selected from the group consisting of a sulfur compound, a selenium compound, a reducing compound and a noble metal compound; and said silver halide emulsion being spectrally sensitized with a methine dye.

The present invention also relates to a method for preparing a silver halide light-sensitive material comprising a support having thereon at least one light-sensitive silver halide emulsion layer comprising the steps of:

(a) preparing an emulsion comprising a silver halide grain matrix;

(b) forming protrusions on said silver halide grain matrix at a silver potential of at least about +110 mV, at least about 50 wt% of said silver halide grain matrix having thereon from about 10 to 10,000 protrusions per square micrometer of grain matrix surface, said individual protrusions having an average projected area diameter of up to about 0.15 μm, and a halogen composition of said protrusions having a halogen composition differing from that of said grain matrix;

(c) stabilizing the grains obtained in step (b) with a grain formation-stopping agent; and (d) then chemically sensitizing said stabilized grains.

DETAILED DESCRIPTION OF THE INVENTION

Figure 1:
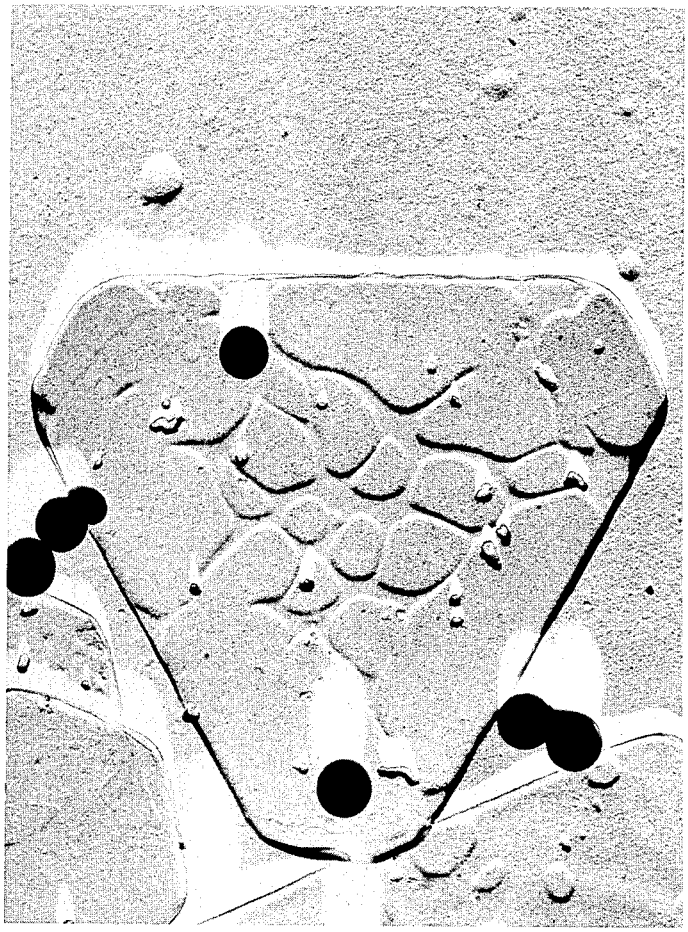
FIGS. 1 to 4 are electron photomicrography (×20,000) of silver halide crystal grains contained in the emulsions 1 to 4, respectively, of Example 1.

The present invention will hereinafter be explained in detail.

The relation between the size of protrusion on the grain surface and the specific surface area can be easily understood, for example, by the following calculation.

Assuming that triangular pyramid-shaped protrusions having a similar (100) plane cover a unit area of the (111) plane such that the total volume of protrusion having a projected area diameter of 0.2 μm is equal to that of protrusions having a projected area diameter of 0.1 μm; for example, that the number of protrusions having a projected area diameter of 0.2 μm is 4 and that of protrusions having a projected area diameter of 0.1 μm is 32, then the surface area is as follows:

Grain matrix having no protrusion: 1

Grain matrix having protrusions having a projected area diameter of 0.2 μm: 1.18

Grain matrix having protrusions having a projected area diameter of 0.1 μm: 1.34

As is apparent from the above calculation, small protrusions are advantageous as compared with large protrusions with respect to specific surface area.

The projected area diameter is measured by observation due to a electron microscope. The specific surface area is measured by B.E.T. method as described in G. Gregg, *The Surface Chemistry of Solids,* 2nd ed., Reinhold Publishing Corp., N.Y. (1961).

The silver halide grain of the present invention comprises a grain matrix having on its surface a number of distinct raised areas, for simplicity referred to generally herein as "protrusions". It is necessary for the present invention that the halogen compositions of the grain matrix portion is different from that of the protrusion portion each other. The halogen composition of the grain matrix is preferably AgBr or AgBrI. A small amount (i.e., 5 mol% or less) of silver chloride may be incorporated in the grain matrix.

The halogen composition of the protrusion is preferably AgBr, AgBrCl or AgCl. Preferred are AgBrCl or AgCl containing at least about 30 ml% silver chloride. More preferred are AgBrCl or AgCl contains at least about 75 mol% silver chloride. It is preferred that silver iodide be absent, but a small amount (i.e., 2 mol% or less) of the silver iodide may be incorporated in the protrusion.

In connection with the halogen composition of the grain matrix and the halogen composition of the protrusions, it is particularly preferred that the grain matrix be AgBrI containing not more than about 10 mol% of AgI and the protrusions be AgBrCl containing not less than about 50 mol% of AgCl.

As the grain matrix, grains in which the (111) plane constitutes at least about 50% of the total grain matrix surface are preferred, and those in which the (111) plane constitutes at least about 75% of the total grain matrix surface are more preferred. The shape of the grain matrix is preferably such that the ratio of the projected area diameter to the grain thickness (aspect ratio) is high; that is, tabular grains having an aspect ratio of about 5 to 20 are preferred. Tetradecagonal, octahedral or irregular-shaped twin grains can be used as the grain matrix as long as the (111) plane constitutes at least about 50% of the total grain surface area.

Further, the more preferably excellent effect of the present invention can be obtained by the use of a monodispersed emulsion containing tabular grains. The tabular grains can be prepared by methods which are described in Gutoff, *Photographic Science and Engineering,* Vol. 14, pp. 248–257 (1970), U.S. Pat. Nos. 4,434,226, 4,414,310, 4,433,048 and 4,439,520, British Pat. No. 2,112,157, and Japanese patent application (OPI) No. 127921/83. The structure and method of preparation of a monodispersed emulsion containing tabular grains are described in Japanese patent application No. 299155/86.

That is, at least about 70% based on a total projected area of the silver halide grains comprise silver halide tabular grains having a sexangle of which a ratio of the minimum side length/the maximum side length is 2 or less and two parallel outside surfaces.

Further, the coefficient of variation of grain size distribution of the silver halide sexangle tabular grains (i.e., the value obtained by dividing the standard deviation of grain size represented by grain diameter corresponding to a circle of the projected area by the average grain size.) is 20% or less, the aspect ratio of the silver halide sexangle tabular grain is 2.5 or more, and the silver halide sexangle tabular grain size is 0.2 μm or more. Further, the silver halide sexangle tabular grain emulsion is a monodispersed emulsion.

Furthermore, a regular crystal form such as octahedral and dodecahedral and an irregular crystal form such as twinned crystal can be prepared by methods which are described in T. H. James, *The Theory of the Photographic Process,* 4th edition, MacMillan.

The proportion of the (111) plane area in the grain matrix can be determined by the Kubelka-Munk's dye adsorption process. For example, as described in *Journal of Imaging Science,* Vol. 29, pp. 165–171 (1985), a dye which is adsorbed preferentially onto either the (111) plane or the (100) plane and which produces a dye association state on the (111) plane and a dye association state on the (100) plane which can be spectrally differentiated is selected, and added to an emulsion, and the spectro spectrum vs. amount of dye added is examined in detail, whereby the plane proportion of the (111) plane can be determined.

The silver halide grains having protrusion which are used in the present invention constitute at least about 50% (by weight), preferably at least about 70 wt% and more preferably at least about 90 wt% of the total silver halide grains contained in the emulsion layer.

The protrusion of the present invention is represented by two constants specifying the shape thereof. One is a projected area diameter, which is not more than about 0.15 μm, preferably not more than about 0.13 μm and more preferably from about 0.01 to 0.11 μm. The projected area diameter is the diameter of a circle having the same surface area as that of the projected area of the protrusion from the surface thereof.

The other is a height of the protrusion from the grain matrix surface. The height of the protrusion is more preferred as it is higher. When the protrusion is a triangular pyramid containing a (100) plane, the height of the protrusion is 0.55 times the projected area diameter of the triangular pyramid.

The protrusion of the present invention has a height generally from 0.4 to 10 times, preferably from 0.45 to 8 times, and more preferably from 0.5 to 5 times, the projected area diameter. Generally, the protrusion of the present invention is a triangular pyramid, but the protrusion of the present invention is not limited to it.

The number of protrusions per square micrometer is about $1\times10$ to $1\times10^4$, preferably about $2\times10$ to $1\times10^4$ and more preferably about $3\times10$ to $1\times10^4$.

Without being bound in any way by theory, it is considered that the main reason why a number of protrusions are formed on the grain surface in the present invention is that the lattice constant of the grain matrix portion is different from that of the protrusion portion. The lattice constant of a silver halide composition is described in, for example, T. H. James, *The Theory of the Photographic Process*, pp. 3–4, 4th ed., MacMillan Inc., N.Y. (1977). If the lattice constant of the grain matrix portion is greatly different from that of the protrusion portion, the growth of the protrusion portion proceeds until the strain of the lattice structure cannot be released in relation to the growth in the plane direction of the grain matrix. Thus, a greater difference between the lattice constant of the grain matrix portion and that of the protrusion portion should result in increased growth of the protrusion portion in directions other than the plane direction of the grain matrix forming the protrusions of the present invention. The details, however, are not clear.

The size distribution of the grain matrix may be narrow or broad. One preferred grain matrix is a monodispersed emulsion having a narrow size distribution (coefficient of variation: not more than 20%).

In connection with the size of the grain matrix, the average projected area diameter is preferably at least about 0.5 μm, more preferably from 0.7 to 20 μm and particularly preferably from 1.0 to 10 μm.

The silver halide emulsion used in the present invention can be prepared by any techniques known in the art of silver halide photographic materials. More specifically, after the grain matrix is formed, protrusions are formed on the grain matrix surface.

For preparation of the grain matrix, any conventional techniques such as the acidic method, the neutral method and the ammonia method can be employed. The method of reacting a soluble silver salt and a soluble halogen salt can be chosen from the single jet method, the double jet method, and a combination thereof.

In addition, as one example of the double jet method, a method in which the pAg of a liquid phase where a silver halide grain is to be formed is maintained at a constant level, i.e., the controlled double jet method, can be employed. As another example other than the double jet method, the triple jet method, in which soluble halogen salts having different compositions (for example, soluble silver salts, soluble halogen salts) are added independently can be employed. At the time of preparation of the grain matrix, a silver halide solvent, e.g., ammonia, rhodane salts, thioureas, thioethers and amines may be used. An emulsion having a narrow size distribution of the grain matrixes is preferably used. Particularly preferred is the above-described monodispersed grain matrix emulsion. An emulsion having grain matrixes with a uniform halogen composition, and particularly a uniform content, is preferably used.

It can be determined by X-ray diffraction and the EPMA method whether the halogen composition of individual grains is uniform. When the halogen composition of the grain matrix is uniform, the X-ray diffraction pattern has a narrow diffraction width and a sharp peak.

In preparation of silver halide grains of the present invention, the surface of which is almost covered with protrusions, the protrusions may be formed immediately after the formation of the grain matrixes, or they may be formed after the grain matrixes are washed with water for desalting.

The protrusions are preferably formed by adding at such high speed that formation of nuclei does not occur a water-soluble silver salt and a water-soluble halogen salt which correspond to the composition of the protrusions.

The protrusions are formed at a high silver potential of at least about +110 mV, preferably from +120 to +140 mV, more preferably from +130 to +350 mV, and most preferably from +130 to 300 mV, although the silver potential varies with the halogen composition of the protrusions and/or the temperature and/or additives and the like during the formation of the protrusions.

The values of the silver electric potential of the present invention are measured by a saturated calomel electrode (S.C.E.).

The temperature during the preparation of the protrusions is preferably low. The temperature is typically not more than about 80° C., preferably not more than about 70° c. and more preferably not more than about 65° C. although it varies depending on other conditions during the formation of the protrusions.

Additives which become silver halide solvents during the formation of the protrusions are preferably not used, but they may be used within the range that the grain matrix and the protrusion are not intermingled with each other more than necessary.

In the silver halide grains of the present invention, prior to chemical sensitization, it is necessary to add a grain formation stopping agent to the silver halide grains in an amount of not less than about $1\times10^{-4}$ mol, preferably not less than about $5\times10^{-4}$ mol and more preferably not less than about $1\times10^{-3}$ mol, but not more than about $5\times10^{-2}$ mol and preferably not more than about $1\times10^{-2}$ mol per mol of Ag in the grains for the purpose of stabilizing the protrusions. The grain formation-stopping agent is added after the formation of the protrusions but prior to the chemical sensitization. In particular, it is preferred that the grain formation-stopping agent be added at any point during the period from the formation of the protrusions to the water washing step.

The term "grain formation-stopping agent" as used herein means a compound which is firmly adsorbed on the silver halide surface, thereby preventing the shape of the grain from changing. For example, mercapto compounds, azole compounds, dyes and combinations thereof can be used.

For example, such compounds include many compounds known as antifoggants or stabilizers, e.g., azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotraizines; thioketo compounds such as oxazolinethione; and azaindenes such as triazaindenes, tetraazaindenes (particularly 4-hydroxy-substituted (1,3,3a,7)tetraazaindene), and pentaazaindenes; benzenethiosulfonic acid, benzenesulfinic acid, benzenesulfonic acid amide and the like can be used.

Adenines can also be used.

Dyes which can be used include many dyes known as sensitizing dyes, e.g., cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes, and complex merocyanine dyes. These dyes can contain any nuclei commonly used as the basic heterocyclic nuclei in the cyanine dyes, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei obtained by fusing alicyclic hydrocarbon rings to the above nuclei; and the nuclei obtained by fusing aromatic hydrocarbon rings to the above nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, benzimidazole nucleus, a quinoline nucleus, etc. Each of these nuclei may be substituted at the carbon atom thereof.

For the merocyanine dyes or complex merocyanine dyes, can be applied nuclei with a ketomethylene structure, e.g., 5- or 6-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus, and a thioarbituric acid nucleus.

As the grain formation-stopping agent, any of the aforementioned mercapto compounds, azoles, dyes, etc., can be used. Of these compounds, dyes, e.g., dyes D-1 to D-45 as described hereinafter are particularly preferred, to prevent problems even if the grain formation-stopping agent is present during the subsequent process of e.g., chamical sensitization or spectral sensitization.

Of the dyes, merocyanine dyes are particularly preferred because of their great ability to stop grain formation. Such merocyanine dyes include the compounds represented by formula (I):

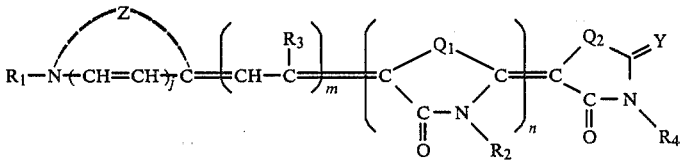

(I)

In formation (I), Z represents an atomic group necessary for forming a 5- or 6-membered hetero ring, including, e.g., thiazoline, thiazole, benzothiazole, naphthothiazole, selenazoline, selenazole, benzoselenazole, naphthoselenazole, benzoxazole, naphthoxazole, benzimidazole, naphthoimidazole, pyridine, quinoline and pyrrolidine. These 5- and 6-membered hetero rings may be substituted.

$Q_1$ and $Q_2$, which may be the same or different, each represents a sulfur atom, a selenium atom, or a $>N—R_5$ group. $R_5$ represents alkyl group having not more than 8 carbon atoms and a monocyclic aryl group having not more than 12 carbon atoms which may contain oxygen atom, a sulfur atom or a nitrogen atom in the carbon chain and may be substituted by a hydroxyl group, a halogen atom, an alkylaminocarbonyl group, an alkoxycarbonyl group, a carbonyl group, or a phenyl group which may be further substituted. Particularly preferred is an alkyl group having not more than 6 carbon atoms, which may be substituted by a hydroxyl group, an alkylaminocarbonyl group, an alkoxycarbonyl group, or a carboxyl group and may contain an oxygen atom in the carbon chain, or a phenyl group or a pyridyl group which may be substituted by a hydroxyl group, an alkyl group, a chlorine atom, or an alkoxy group.

Y represents a sulfur atom or a selenium atom.

$R_1$ represents an alkyl group or alkenyl group, having not more than 8 carbon atoms, which may contain an oxygen atom and a sulfur atom in the carbon chain and may be substituted.

$R_2$ and $R_4$, which may be the same or different, each represents the same groups as defined for $R_1$, a hydrogen atom, or a monocyclic aryl group having not more than 8 carbon atoms which may be substituted.

$R_3$ is a hydrogen atom, a phenyl group having not more than 8 carbon atoms which may be substituted by a group or groups, e.g., an alkyl group, an alkoxy group, a chlorine atom, a carboxyl group and a hydroxyl group; or an alkyl group having not more than 6 carbon atoms which may be substituted.

At most one of $R_1$, $R_2$ and $R_4$ contains a sulfo group.

j represents 0 or 1.

m represents 0, 1, 2 or 3.

n represents 0 or 1.

When m is 2 or 3, the plural $R_3$ groups may be linked to form a 5- or 6-membered ring.

It is more preferred that m is 0, 1 or 2, and n is 0.

Particularly preferred substituents for substituted 5- or 6-membered hetero rings formed by Z include a chlorine atom, a cyano group, an alkoxy carbonyl group having not more than 5 carbon atoms, a perfluoroalkyl group having not more than 4 carbon atoms and an acyl group having not more than 5 carbon atoms (e.g., an acetyl group and a metasulfonyl group) when the heterocyclic nucleus is benzimidazole; and when the heterocyclic nucleus is a group other than the benzimidazole, particularly preferred substituents include an alkyl group having not more than 5 carbon atoms (which may be substituted by, for example, a hydroxyl group, a carboxyl group, a halogen atom, a phenyl group, an alkoxycarbonyl group and an alkoxy group), a phenyl group having not more than 8 carbon atoms (which may be substituted by, for example, a hydroxyl group, a halogen atom, an alkoxy group, an acylamino group, an alkylaminocarbonyl group and a carbonyl group), a furyl group, a thienyl group, a pyridyl group, an alkoxy group having not more than 5 carbon atoms, an alkoxycarbonyl group having not more than 5 carbon atoms, a hydroxyl group, a halogen atom or a carboxyl group.

Preferred examples of the substituents for $R_1$ include a sulfo group, a carboxyl group, a hydroxyl group, a halogen atom, an alkoxy carbonyl group, a carbamoyl group, a phenyl group which may be substituted, and a single hetero ring.

Preferred examples of the substituents for $R_2$ and $R_4$ include an alkyl group, an alkoxy group, a chlorine atom, a carboxy group, a sulfo group and an acylamino group. Preferred examples of the aryl group represented as $R_2$ and $R_4$ include a phenyl group, a pyridyl group, a furyl group and a thienyl group.

In the present invention, in the process of formation or physical ripening of silver halide grains, cadmium salts, zinc salts, lead salts, thallium salts, iridium salts or complex salts, rhodium salts or complex salts, iron salts or complex salts, and the like may coexist.

The silver halide emulsion of the present invention is subjected to chemical sensitization. For this chemical sensitization, for example, the methods described in H. Frieser ed., *Die Grundlagen der Photographischen Prozesse mit Silverhalogeniden,* pp. 675–734, (Akademische Verlagsgesellschaft, 1968) can be used.

That is, the sulfur sensitization method using sulfur-containing compounds capable of reacting with active gelatin and silver (e.g., thiosulfuric acid salts, thioureas, mercapto compounds and rhodanines), the selenium sensitization method, the reduction sensitization method using reducing substances (e.g., tin (II) salts, amines, hydrazine derivatives, formamidinesulfinic acid and silane compounds), the noble metal sensitization method using noble metal compounds (e.g., gold complex salts, and complex salts of Group VIII metals such as Pt, Ir and Pd), and so on can be employed alone or in combination with each other.

The sulfur sensitization method is described in, for example, U.S. Pat. Nos. 1,574,944, 2,410,689, 2,278,947, 2,728,668, and 3,656,955. The selenium sensitization method is described in, for example, U.S. Pat. Nos. 1,574,944, 1,602,592, and 1,623,499. The reduction sensitization method is described in, for example, U.S. Pat. Nos. 2,983,609, 2,419,974 and 4,054,458. The noble metal sensitization method is described in, for example, U.S. Pat. Nos. 2,399,083, 2,448,060, and British Pat. No. 618,061.

As a protective colloid which can be used in preparation of the emulsion of the present invention and a binder which can be used for other hydrophilic layers, it is advantageous to use gelatin. Other hydrophilic colloids may also be used.

For example, proteins such as gelatin derivatives, graft polymers of gelatin and other polymers, albumin and casein; sugar derivatives such as cellulose derivatives (e.g., hydroxyethyl cellulose, carboxymethyl cellulose and cellulose sulfate), sodium alginate and starch derivatives; and a number of synthetic hydrophilic polymer substances, e.g., homopolymers or copolymers, such as polyvinyl alcohol, polyvinyl alcohol partial acetal, poly-N-vinyl pyrrolidone, polyacrylic acid, polymethacrylic acid, polyacrylamide, polyvinyl imidazole and polyvinyl pyrazole can be used.

As the gelatin, lime-processed gelatin can be used. In addition, acid-processed gelatin and enzyme-processed gelatin as described in *Bull. Soc. Sci. Phot. Japan,* No. 16, p. 30 (1966) can be used. Hydrolyzates and enzyme-decomposition products of gelatin can be used.

Various compounds can be incorporated in the photographic emulsions to be used in the present invention, for the purpose of preventing fog during the process of preparation, preservation for use or photographic processing of the light-sensitive material, or of stabilizing photographic performance. For example, many compounds known as antifoggants or stabilizers, e.g., azoles such as benzothiazolium salts, nitroindazoles, nitrobenimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; thioketo compounds such as oxazolinethione; azaindenes such as triazaindenes, tetraazaindenes (particularly 4-hydroxy substituted (1,3,3a,7) tetraazaindenes), and pentaazaindenes; benzenethiosulfonic acid, benzenesulfinic acid and benzenesulfonic acid amide can be added. For example, the compounds described in U.S. Pat. Nos. 3,954,474, 3,982,947 and Japanese Patent Publication No. 28660/77 can be used.

In the photographic emulsion layer of the photographic material of the present invention, for the purpose of increasing sensitivity or contrast, or of accelerating development, a polyalkylene oxide or its derivatives (e.g., ethers, esters and amines), thioether compounds, thiomorpholines, quaternary ammonium salt compounds, urethane derivatives, urea derivatives, imidazole derivatives, and 3-pyrazolidones may be incorporated. For example, the compounds described in U.S. Pat. Nos. 2,400,532, 2,423,549, 2,716,062, 3,617,280, 3,772,021, 3,808,003, and British Pat. No. 1,488,991 can be used.

Methine dyes which are used in the present invention for spectral sensitization are described in, for example, F. M. Hamer, *The Chemistry of Heterocyclic Compounds,* Vol. 18, A. Weissberger ed., *The Cyanine Dyes and Related Compounds,* (Interscience Inc., New York, 1964), D. M. Sturmer, *The Cyanine Dyes and Related Compounds,* A. Weissberger, E. C. Taylor ed., John Willey Co., New York (1977), *Research Disclosure,* Vol. 176, No. 17643, pp. 23–24 (1978), German Pat. No. 929,080, U.S. Pat. Nos. 2,231,658, 2,493,748, 2,503,776, 2,519,001, 2,912,329, 3,656,959, 3,572,897, 3,694,217, 4,025,349, 4,046,572, British Pat. No. 1,242,588, Japanese patent publication Nos. 14030/69, 24844/77, British Pat. Nos. 584,609, 1,177,429, Japanese patent application (OPI) Nos. 85130/73, 99620/74, 11442/74, 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

These spectral sensitizers can be used alone or in combination with each other. Combinations of spectral sensitizers are often used for the purpose of super sensitization.

In combination with spectral sensitizers, dyes not having a spectral sensitization action by themselves or substances substantially not absorbing visible light and exhibiting super sensitization can be used. For example, aminostylbene compounds substituted by a nitrogen-containing heterocyclic group (as described in, for example, U.S. Pat. Nos. 2,933,390 and 3,635,721), aromatic organic acid-formaldehyde condensates (as described in, for example, U.S. Pat. No. 3,743,510), cadmium salts, azaindene compounds, etc. may be incorporated. The combinations described in U.S. Pat. Nos. 3,615,613, 3,615,641, 3,617,295 and 3,635,721 are particularly useful.

Typical examples of dyes which are used as grain formation-stopping agents and/or spectral sensitizers in the present invention are shown below, but the present invention is not to be construed as being limited thereto.

D-1
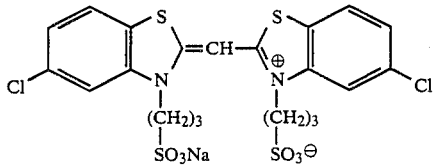
D-2
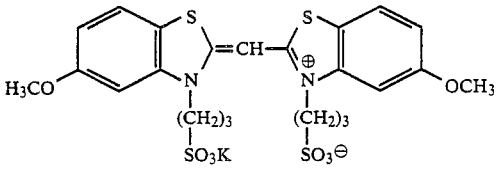
D-3
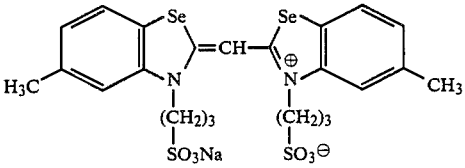
D-4
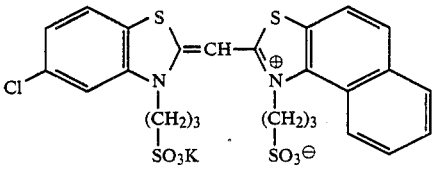
D-5
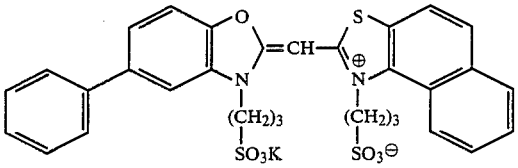
D-6
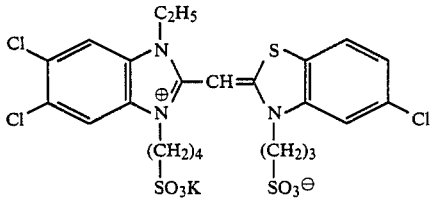
D-7
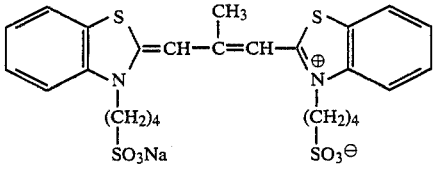
D-8
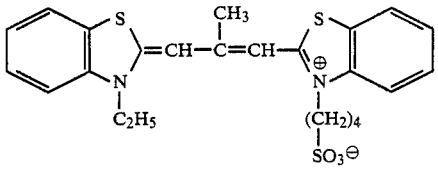
D-9
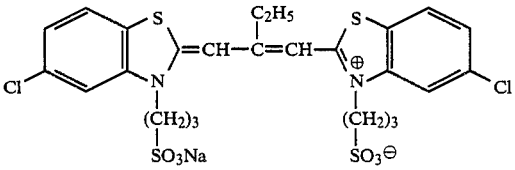
D-10
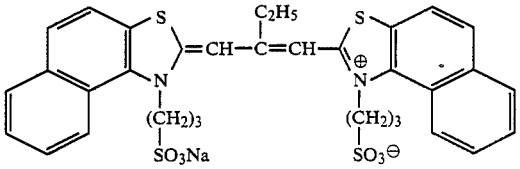
D-11
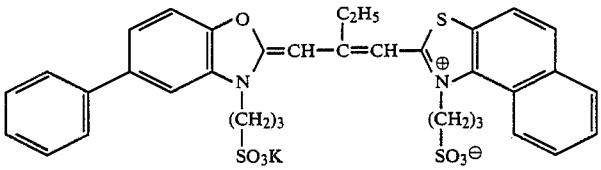
D-12
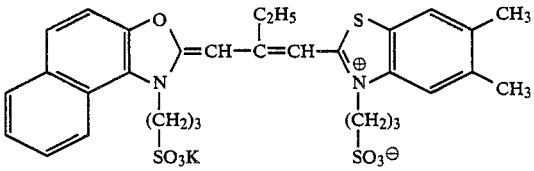
D-13
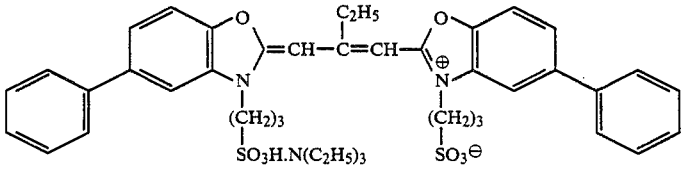

-continued
D-14
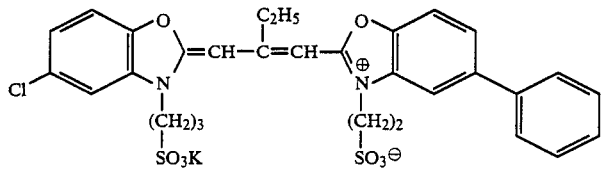
D-15
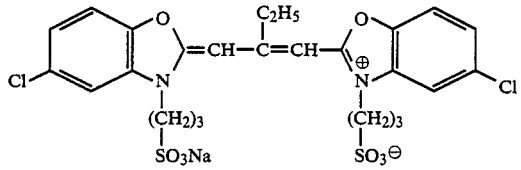
D-16
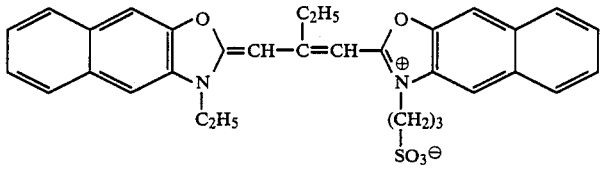
D-17
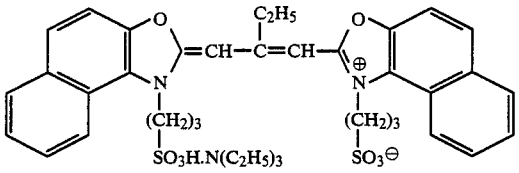
D-18
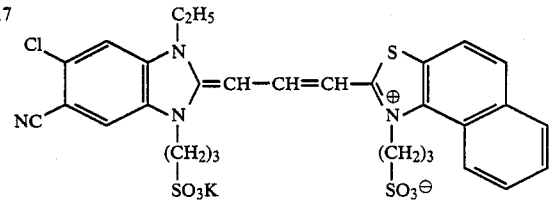
D-19
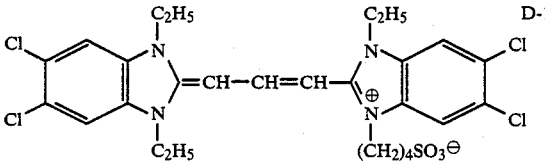
D-20
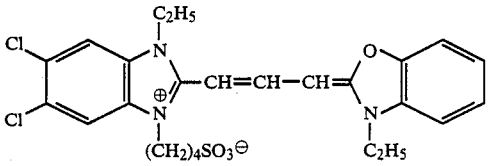
D-21
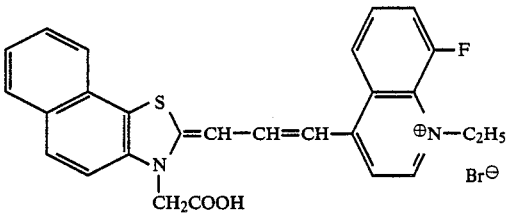
D-22
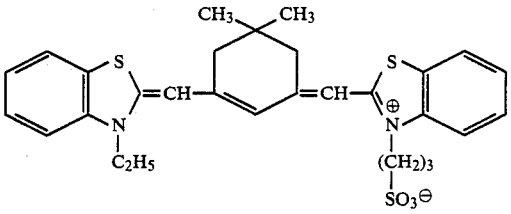
D-23
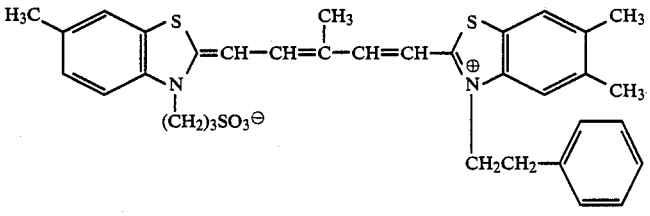
D-24
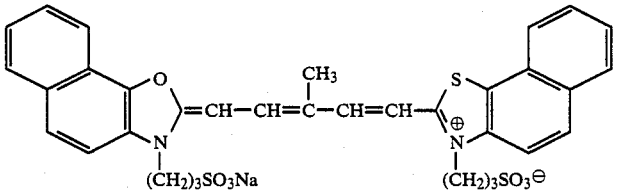

-continued
D-25
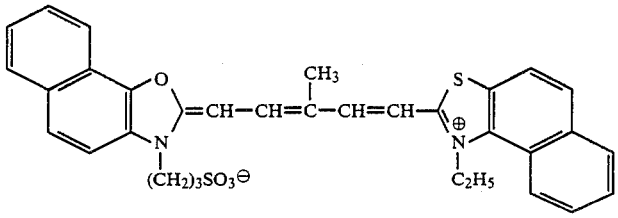
D-26
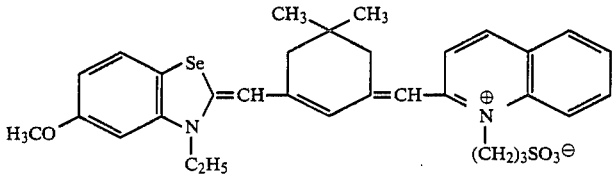
D-27
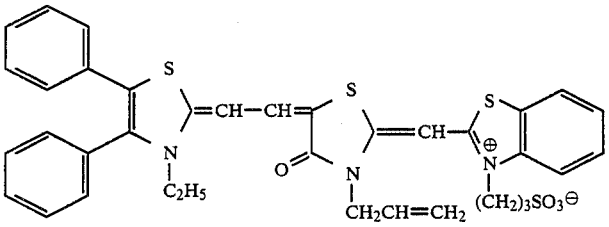
D-28
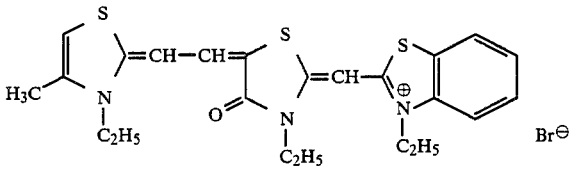
D-29
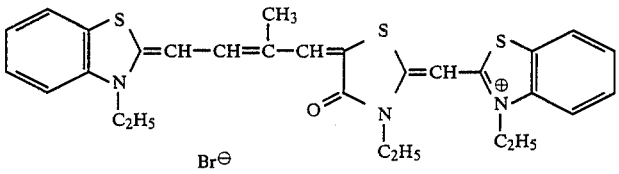
D-30
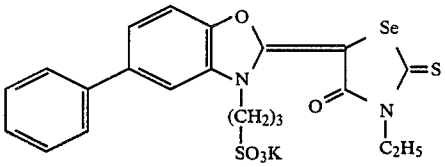
D-31
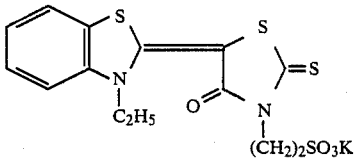
D-32
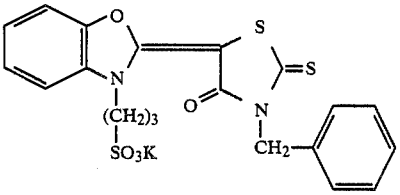
D-33
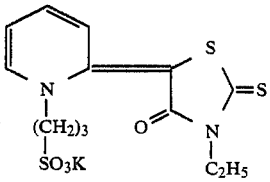
D-34
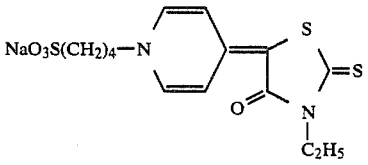
D-35
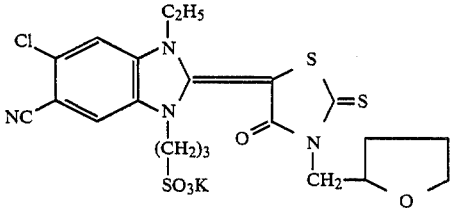

-continued

D-36

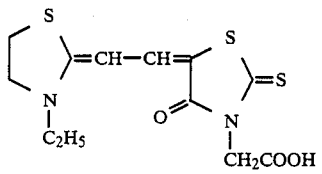

D-37

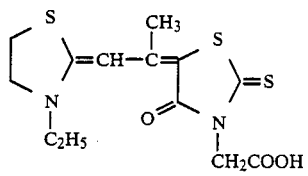

D-38

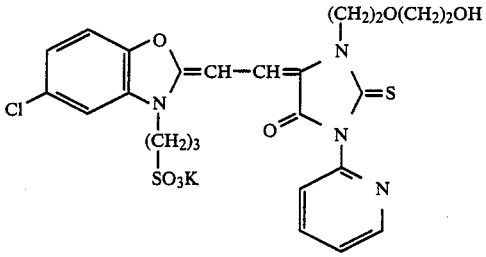

D-39

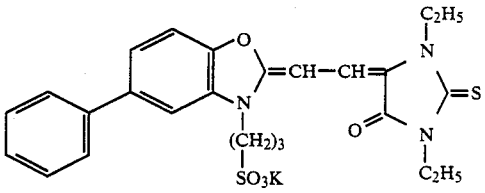

D-40

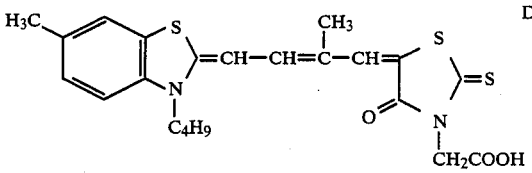

D-41

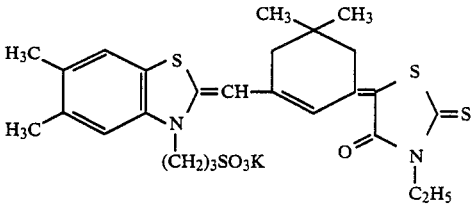

D-42

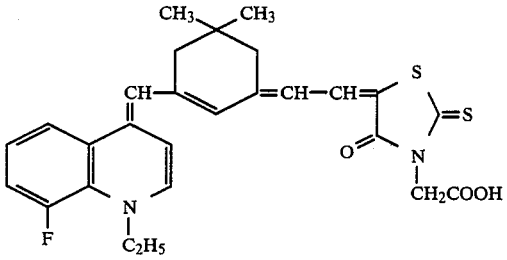

D-43

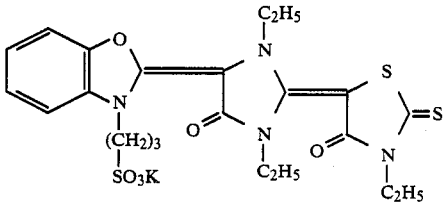

D-44

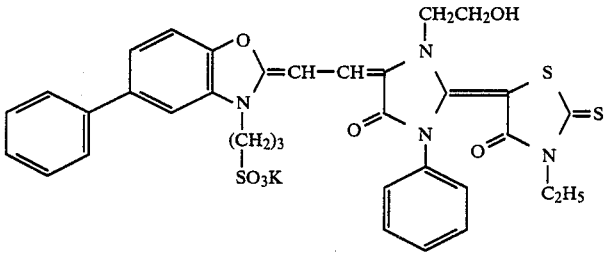

D-45

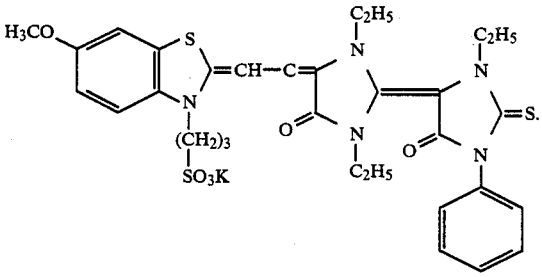

The present invention is described in greater detail with reference to the following examples, but the present invention is not to be construed as being limited thereto. Unless otherwise indicated, all parts, percents and ratios are by weight.

EXAMPLE 1

A silver nitrate solution and potassium bromide solution were added with stirring by the double jet method to a solution containing potassium bromide and gelatin maintained at 70° C. After the completion of addition, the temperature was lowered to 35° C., and soluble salts were removed by the sedimentation method. Then the temperature was raised to 40° C., and 60 g of gelatin was added and dissolved. The pH was adjusted to 6.8 to form Grain Matrix Emulsion A. The grain matrixes thus-obtained were tabular and had an average diameter of 4 μm and a thickness of 0.2 μm.

To 900 g of Emulsion A (corresponding to 70 g of $AgNO_3$) was added 200 ml of water. While maintaining the resulting solution at 50° C., an aqueous solution of silver nitrate (corresponding to 8.5 g of $AgNO_3$) and an aqueous solution of sodium chloride were added by the double jet method while maintaining the silver potential at +40 mv, +100 mV, +160 mV or +190 mV to form protrusions on the grain matrixes, and then 300 ml of 1/250 mol/l (i.e., $4\times10^{-3}$ mol/l)D-13 was added. And the resulting mixture was washed with water and subjected to chemical sensitization with sodium thiosulfate (i.e., hypo) at 50° C. for 20 minutes to prepare Emulsions 1 to 4.

The shapes of the resulting grains examined by an electron microscope are shown in Table 1 below.

TABLE 1

| Emulsion No. | Silver Potential (mV) | Number of Projections of 0.15 μm or less (/μm²) |
|---|---|---|
| 1 (Comparison) | +40 | 0 |
| 2 (Comparison) | +100 | 5 |
| 3 (Invention) | +160 | 50 |
| 4 (Invention) | +190 | 140 |

Emulsion Nos. 1 and 2 are Comparative Examples, and Emulsion Nos. 3 and 4 are Examples of the Present Invention.

Figure 2:
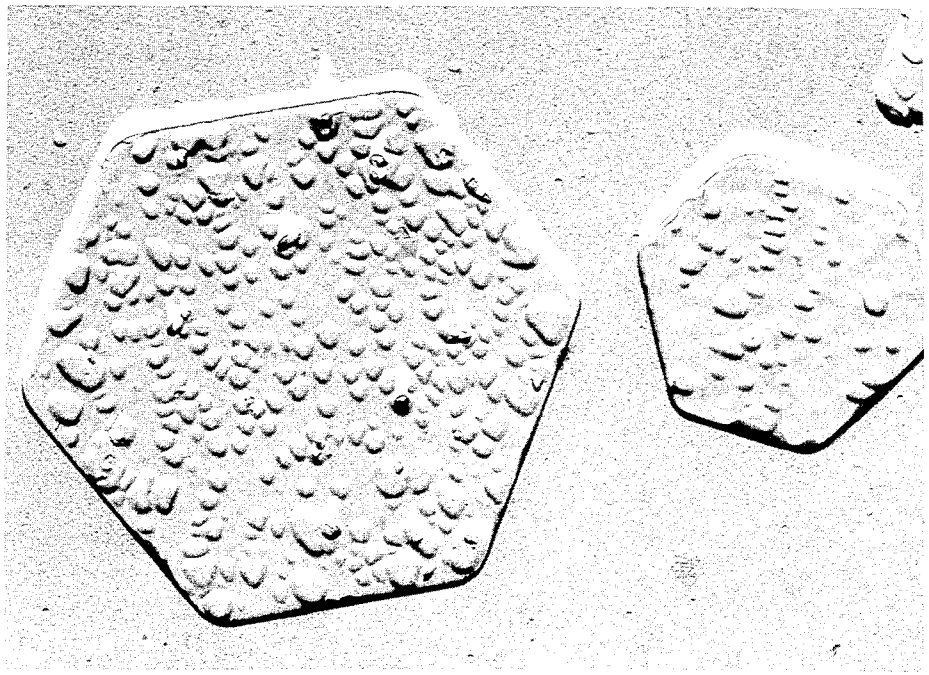
Figure 3:
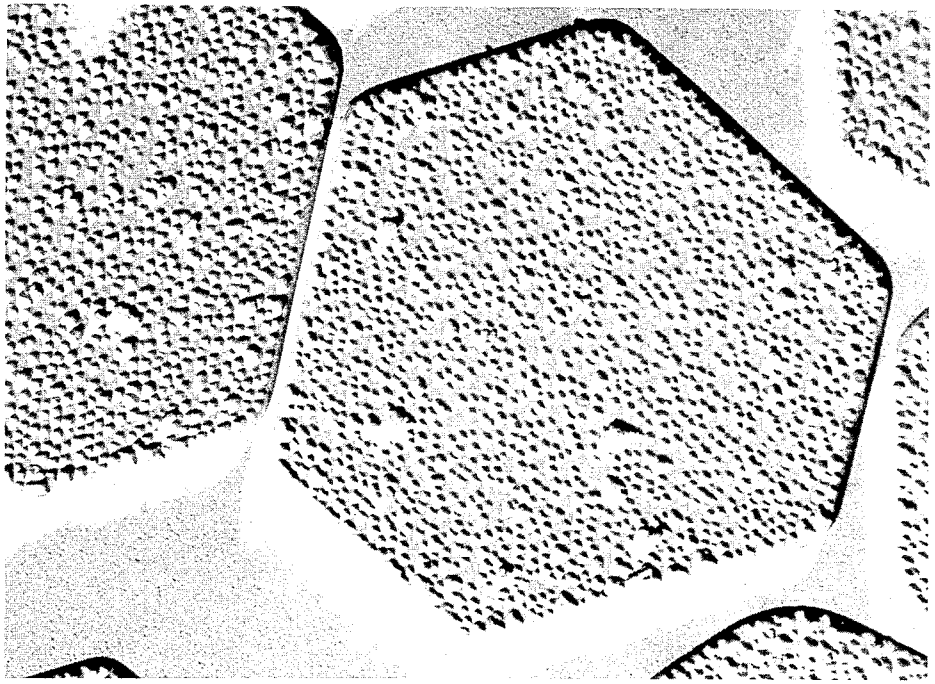
Figure 4:
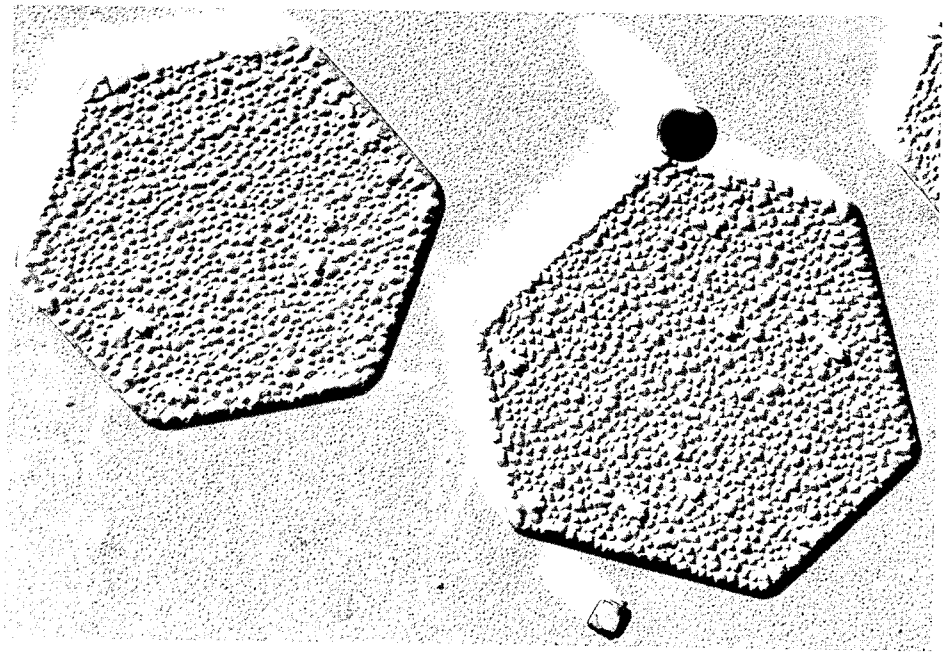

The electron photomicrography of the emulsions 1 to 4 are shown in FIGS. 1 to 4, respectively.

EXAMPLE 2

200 ml of water was added to 900 g of emulsion A, which was maintained at 50° C. An aqueous solution of silver nitrate (corresponding to 8.5 g of $AgNO_3$) and an aqueous solution of sodium chloride were added by the double jet method while maintaining the silver potential at +100 mV and +160 mV, respectively, to form protrusions on the grain matrix surface. After washing with water, to 200 cc of 1/250 mol/l (i.e., $4\times10^{-3}$ mol/l) Dye D-36 was added to the emulsion, and chemical sensitization with sodium thiosulfate (i.e., hypo) was applied at 50° C. for 20 minutes to prepare Emulsions 4 and 5.

Emulsions 7 and 8 were prepared in the same manner as Emulsions 5 and 6, except that Dye D-36 was added after the chemical sensitization.

Electron microscopic examination showed that in Emulsions 5 and 6, similar grains to those in Emulsions 2 and 3 were obtained, but in Emulsions 7 and 8, all protrusions had the height 0.3 times or less the projected area diameter.

The amount of Dye D-36 adsorbed was determined by the reflective spectrum and the Kubelka-Munks equation. The results are shown in Table 2 below.

TABLE 2

| Emulsion No. | Silver Potential (mV) | Addition Point of Dye | Amount Dye Adsorbed* |
|---|---|---|---|
| 5 (Comparison) | +100 | Before chemical sensitization | 115 |
| 6 (Invention) | +160 | Before chemical sensitization | 130 |
| 7 (Comparison) | +100 | After chemical sensitization | 105 |
| 8 (Comparison) | +160 | After chemical sensitization | 110 |
| Emulsion A | — | — | 100 |

Emulsion Nos. 5, 7, 8: Comparative Examples.
Emulsion No. 6: Example of the Present Invention.
*The amount of the dye adsorbed is a relative value based on the adsorption of Emulsion A as 100.

It can be seen from the above results that the emulsion 6 in which protrusions were formed at an silver potential of at least +110 mV and which was stabilized with the dye prior to the chemical sensitization had an increase in the amount of the dye adsorbed.

EXAMPLE 3

Chemical sensitizing agent I shown below was added to 900 g of emulsion A which was prepared in Example 1 to be subjected to chemical sensitization at 45° C. for 20 minutes.

Chemical sensitizing agent I:

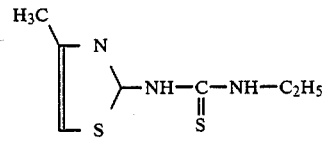

300 ml of 1/250 mol/l (i.e., $4\times10^{-3}$ mol/ ) Dye D-9 was added to the resulting mixture to prepare Emulsion 9.

300 ml of 1/250 mol/l Dye D-9 was added to 900 g of Emulsion A, and then the resulting mixture was subjected to chemical sensitization at 45° C. for 20 minutes using Chemical sensitizing agent I to prepare Emulsion 10.

200 ml of water was added to 900 g of Emulsion A which was maintained at 50° C. An aqueous solution of silver nitrate (corresponding to 8.5 g of $AgNO_3$) and an aqueous solution of sodium chloride were added by the double jet method while maintaining the silver potential at +100 mV. Then, 300 ml of 1/250 mol/l Dye D-9 was added to the emulsion, and chemical sensitization was applied at 45° C. for 20 minutes using chemical sensitizing agent I to prepare Emulsion 11.

Emulsion 12 was prepared by the same manner as in preparation of Emulsion 11, except that silver potential of +100 mV was replaced by the silver potential of +120 mV.

Each of emulsions 9, 10, 11, and 12 was coated on a triacetyl cellulose film support in a coated amount as shown below, and further a protective layer was provided on each of the obtained emulsion layers to prepare Samples 1 to 4.

| | |
|---|---|
| Emulsion Layer | |
| Emulsion (Emulsions 9 to 12) | 3 g/m² (silver content) |
| Sodium Dodecylbenzenesulfonate | 0.1 mg/m² |
| Sodium Dodecylbenzenesulfonate | |
| Potassium Poly-p-styrenesulfonate | 1 mg/m² |
| Gelatin | 4.8 g/m² |
| Protective Layer | |
| Gelatin | 0.7 g/m² |

-continued

| | |
|---|---|
| Sodium N—Oleoyl-N—methyltaurate | 0.2 mg/m$^2$ |
| Polymethyl Metacrylate (finely divided grain, average grain size: 3 μm) | 0.13 mg/m$^2$ |

Samples 3-1 and 3-4 were wedge-exposed in spectral sensitizing region through Sharp Cut Filter SC-50 manufactured by Fuji Photo Film Co., Ltd.

The thus-obtained samples were developed by the following developing solution at 20° C. for 7 minutes, fixed and washed with water, and then dried. And sensitivity of the obtained samples was measured. The results were shown in Table 4.

| | |
|---|---|
| Developing Solution | |
| Metol | 2 g |
| Sodium sulphite | 100 g |
| Hydroquinone | 5 g |
| Borax.10$H_2O$ | 2 g |
| Water to make | 1000 ml |
| Fixing Solution | |
| Ammonium thiosulfate | 240.0 g |
| Sodium sulphite (anhydrous) | 15.0 g |
| Acetic acid (28 wt %) | 48 ml |
| Sodium metaborate | 15.0 g |
| Potassium alum | 15.0 g |
| Water to make | 1000 ml |

TABLE 4

| Sample No. | Emulsion No. | Relative Sensitivity |
|---|---|---|
| 1 (Comparison) | 9 | No image to be obtained |
| 2 (Comparison) | 10 | No image to be obtained |
| 3 (Comparison) | 11 | 100 |
| 4 (Invention) | 12 | 130 |

*The relative sensitivity was expressed in a relative value in terms of a reciprocal of exposure amount that gives an optical density of a fog value +0.2. In Table 4, sensitivity of Sample 3 is taken as 100.

As is apparent from the results of Table 4, Sample 4 according to the present invention could obtain higher sensitivity as compared with comparative samples.

EXAMPLE 4

Emulsion No. 4 of Example 1 was used in the fourth layer of Sample 104 of Example 1 in Japanese patent application (OPI) No. 249148/85, and then was subjected to development by the same manner as in Example 1 of Japanese patent application (OPI) No. 249148/85 to obtain Sample 5. As a result, Sample 5 according to the present invention could obtain an excellent higher sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material comprising a support having thereon at least one light-sensitive silver halide emulsion layer comprising silver halide grains and a binder, at least about 50 wt% of said silver halide grains comprising a silver halide grain matrix having thereon from about 10 to 10,000 protrusions per square micrometer of grain matrix surface, said individual protrusions having an average projected area diameter of up to about 0.15 μm, and a halogen composition of said protrusions differing from that of the grain matrix; said silver halide emulsion being chemically sensitized with at least one compound selected from the group consisting of a sulfur compound, a selenium compound, a reducing compound and a noble metal compound; and said silver halide emulsion being spectrally sensitized with a methine dye.

2. The silver halide light-sensitive material as claimed in claim 1, wherein prior to the chemical sensitization of the silver halide emulsion containing silver halide grain matrixes having protrusions on the surface thereof, the shape of the grain is stabilized with a grain formation-stopping agent.

3. The method as claimed in claim 2, wherein said grain formation-stopping agent is selected from the group consisting of a mercapto compound, an azole compound, a dye, and a combination thereof.

4. The silver halide light-sensitive material as claimed in claim 3, wherein the grain formation-stopping agent is a cyanine dye.

5. The silver halide light-sensitive material as claimed in claim 3, wherein the grain formation-stopping agent is a merocyanine dye.

6. The silver halide light-sensitive material as claimed in claim 3, wherein the grain formation-stopping agent is selected from the group consisting of D-1 to D-45;

D-1

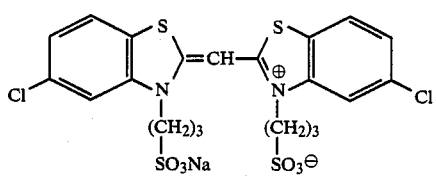

D-2

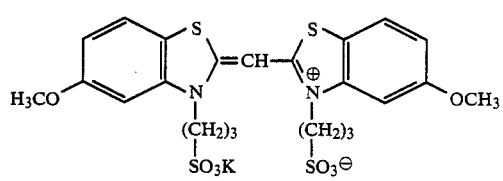

D-3

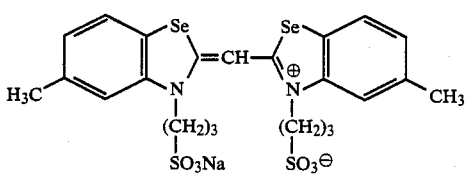

D-4

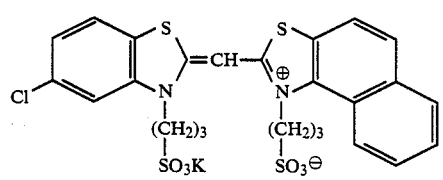

-continued
D-5
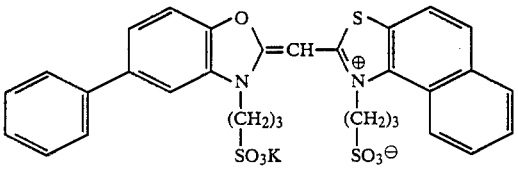
D-6
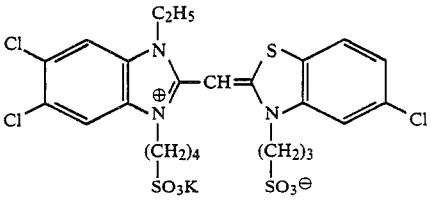
D-7
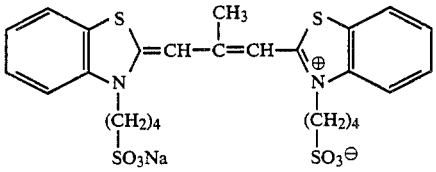
D-8
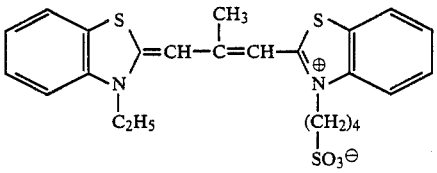
D-9
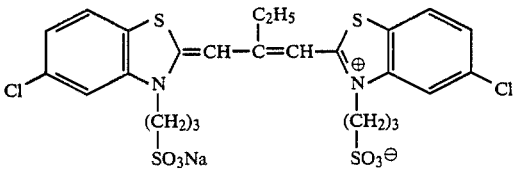
D-10
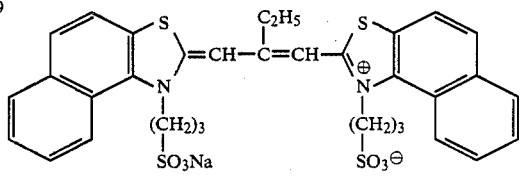
D-11
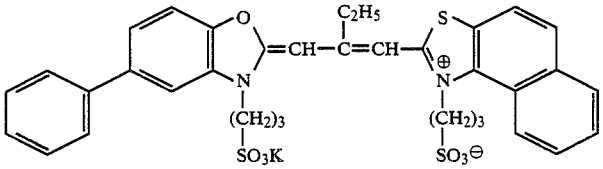
D-12
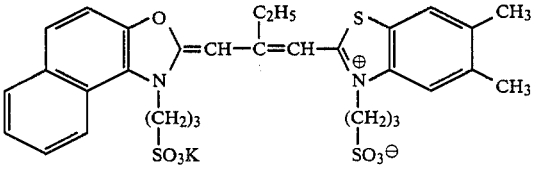
D-13
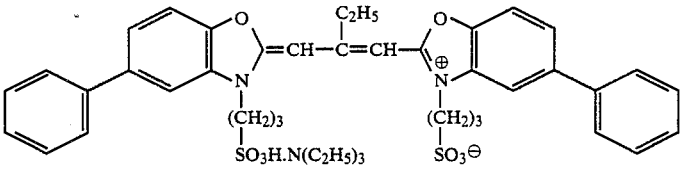
D-14
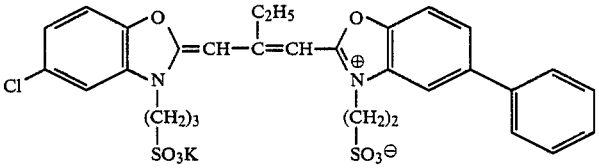
D-15
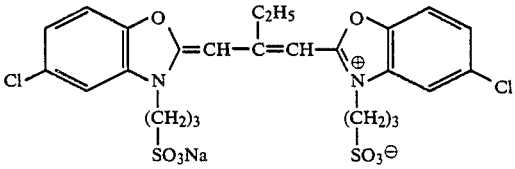

-continued
D-16
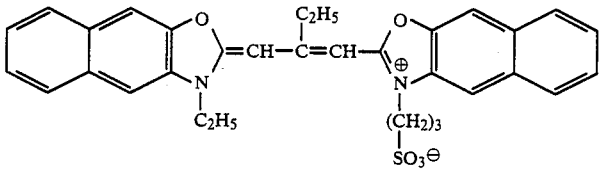
D-17
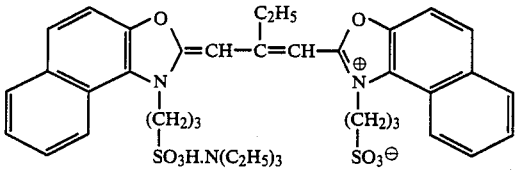
D-18
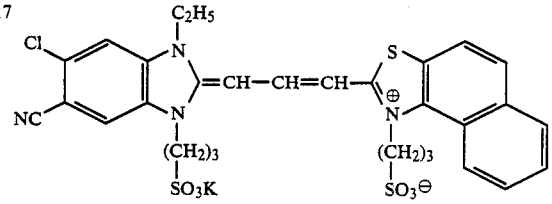
D-19
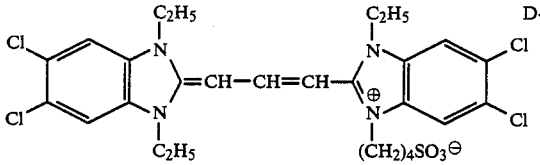
D-20
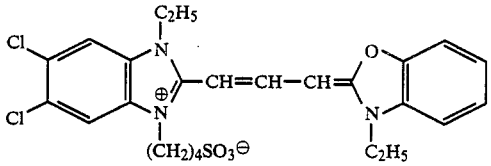
D-21
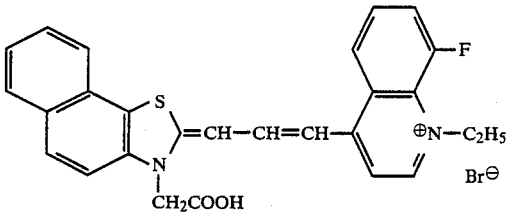
D-22
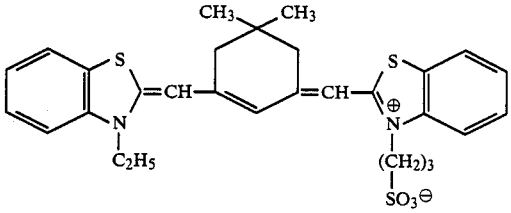
D-23
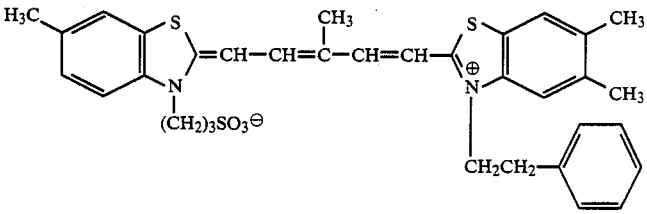
D-24
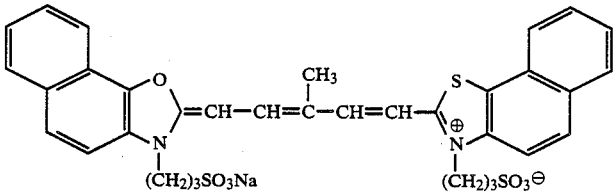
D-25
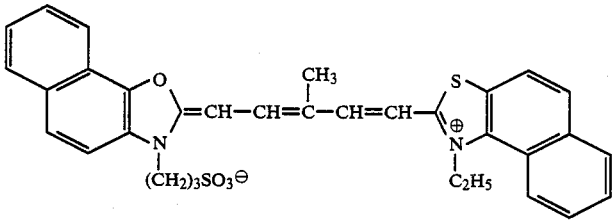
D-26
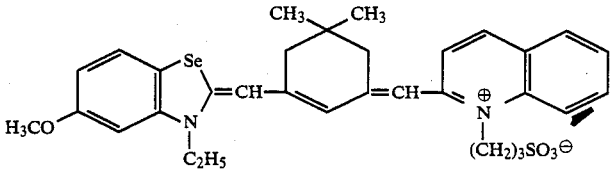

-continued
D-27
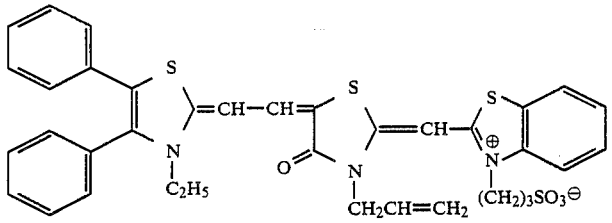
D-28
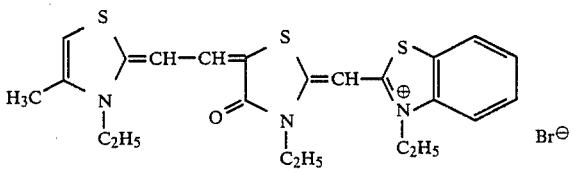
D-29
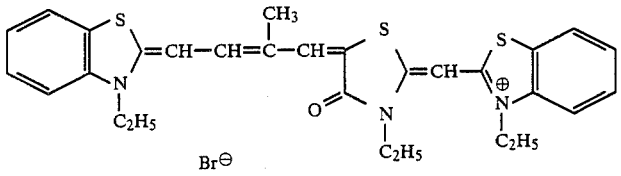
D-30
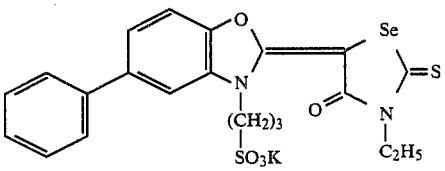
D-31
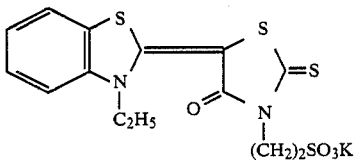
D-32
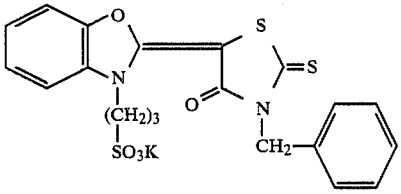
D-33
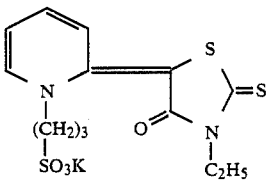
D-34
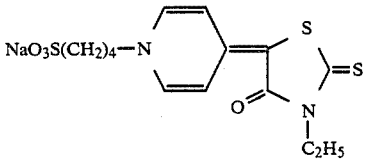
D-35
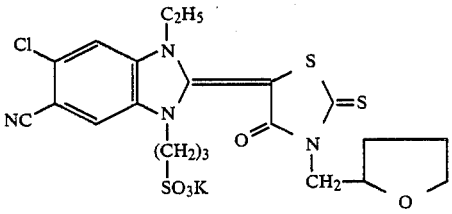
D-36
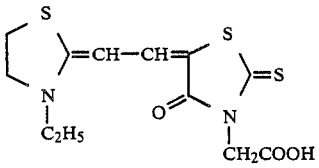
D-37
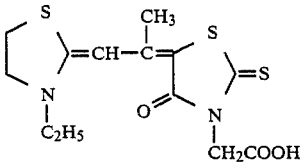

-continued

D-38

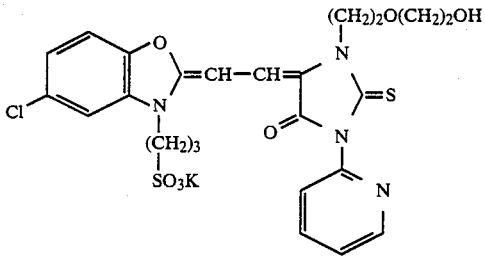

D-39

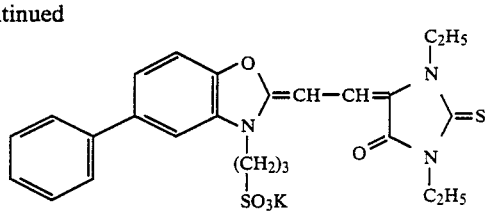

D-40

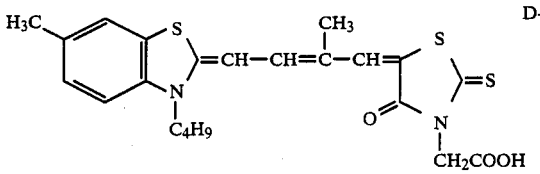

D-41

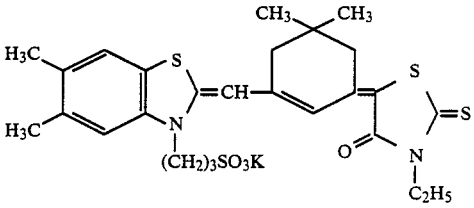

D-42

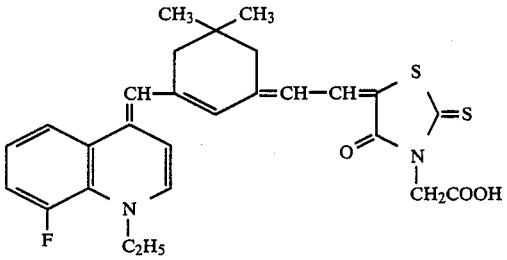

D-43

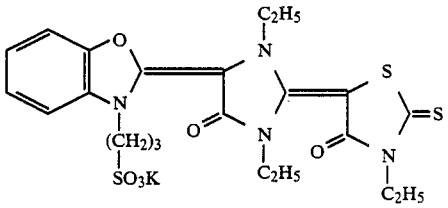

D-44

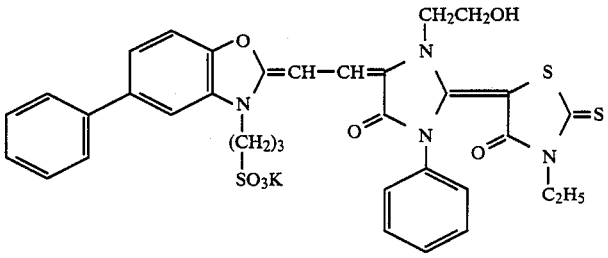

D-45

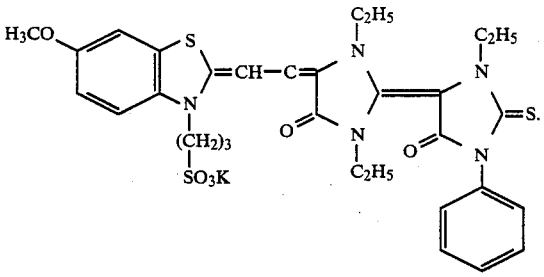

7. The silver halide light-sensitive material as claimed in claim 1, wherein said silver halide grain matrix comprises silver bromide or silver bromoiodide and said protrusions comprise silver bromide, silver bromochloride, or silver chloride.

8. The silver halide light-sensitive material as claimed in claim 7, wherein said silver halide grain matrix comprises silver bromoiodide containing up to about 10 mol% of silver iodide and said protrusions comprise silver bromochloride or silver chloride containing at least about 50 mol% of silver chloride.

9. The silver halide light-sensitive material as claimed in claim 7, wherein said protrusions comprise silver chloride or silver bromochloride containing at least about 30 mol% of silver chloride.

10. The silver halide light-sensitive material as claimed in claim 9, wherein said protrusions comprise silver chloride or silver bromochloride containing at least about 75 mol% of silver chloride.

11. The silver halide light-sensitive material as claimed in claim 1, wherein said silver halide grain matrix has the (111) plane and the total surface area of the (111) planes of the grain matrix is at least about 50% of the total grain matrix surface area.

12. The silver halide light-sensitive material as claimed in claim 1, wherein said silver halide grain matrix is a tabular grain having an aspect ratio of about 5 to 20.

13. The silver halide light-sensitive material as claimed in claim 1, wherein at least about 70 wt% of said silver halide grains comprise the silver halide grain matrix having thereon from about 10 to 10,000 of said protrusions per square micrometer of said silver halide grain matrix surface.

14. The silver halide light-sensitive material as claimed in claim 1, wherein the average projected area diameter of said individual protrusions is up to about 0.13 μm.

15. The silver halide light-sensitive material as claimed in claim 14, wherein the average projected area diameter of said individual protrusions is from about 0.01 to 0.11 μm.

16. The silver halide light-sensitive material as claimed in claim 1, wherein said silver halide grains each have from about 20 to 10,000 of said protrusions per square micrometer of grain matrix surface.

17. The silver halide light-sensitive material as claimed in claim 1, wherein said protrusions are substantially triangular pyramids.

18. The silver halide light-sensitive material as claimed in claim 1, wherein the ratio of the average height of the protrusions to the average projected area diameter thereof is at least about 0.4/1.

19. A method for preparing a silver halide light-sensitive material comprising a support having thereon at least one light-sensitive silver halide emulsion layer comprising the steps of:

(a) preparing an emulsion comprising a silver halide grain matrix;

(b) forming protrusions on said silver halide grain matrix at a silver potential of at least about +110 mV, at least about 50 wt% of said silver halide grain matrix having thereon from about 10 to 10,000 protrusions per square micrometer of grain matrix surface, said individual protrusions having an average projected area diameter of up to about 0.15 μm, and a halogen composition of said protrusions having a halogen composition differing from that of said grain matrix;

(c) stabilizing the grains obtained in step (b) with a grain formation-stopping agent; and (d) then chemically sensitizing said stabilized grains.

20. The method as claimed in claim 19, wherein said silver potential is at least about +120 mV.

21. The method as claimed in claim 19, wherein said stabilizing step comprises adding to said emulsion from about $1\times10^{-4}$ mol to $5\times10^{-2}$ mol of a grain formation-stopping agent per mol of silver contained in said silver halide grains.

22. The method as claimed in claim 19, wherein said grain formation-stopping agent is selected from the group consisting of a mercapto compound, an azole compound, a dye, and a combination thereof.

23. The method as claimed in claim 22, wherein the grain formation-stopping agent is a cyanine dye.

24. The method as claimed in claim 22, wherein the grain formation-stopping agent is a merocyanine dye.

25. The method as claimed in claim 22, wherein the grain formation-stopping agent is selected from the group consisting of D-1 to D-45;

D-1

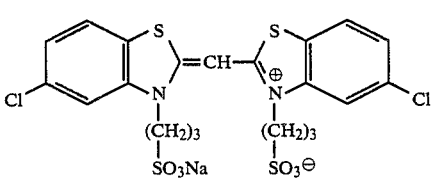

D-2

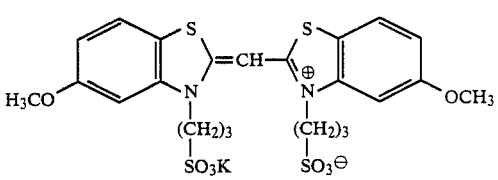

D-3

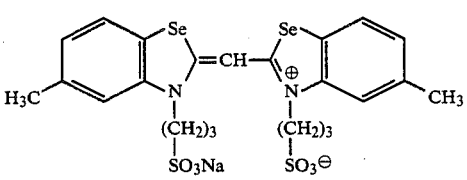

D-4

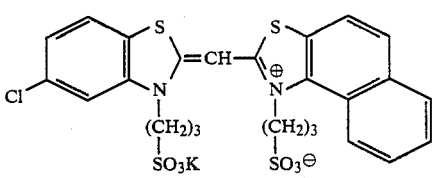

D-5

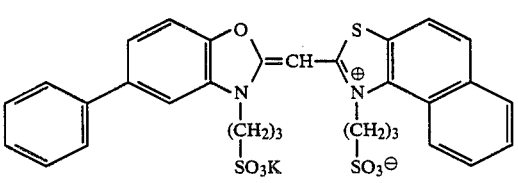

D-6

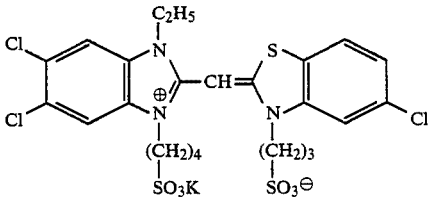

D-7

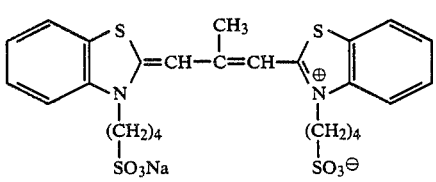

D-8

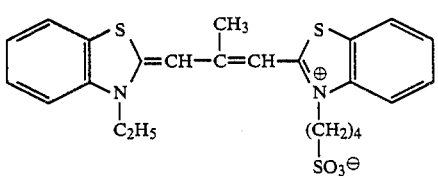

-continued
D-9
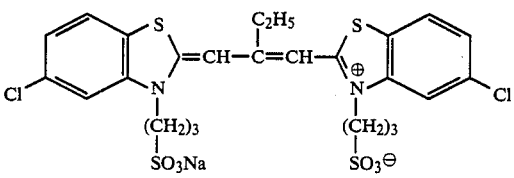
D-10
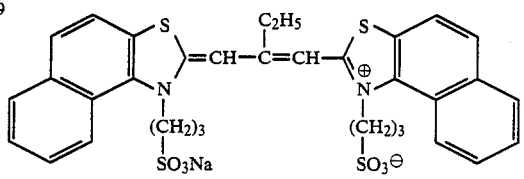
D-11
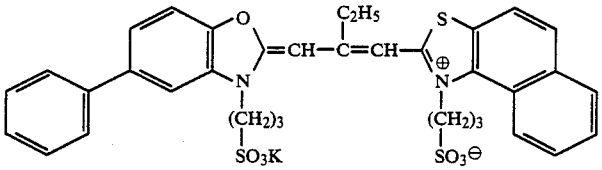
D-12
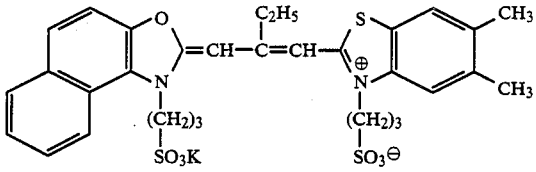
D-13
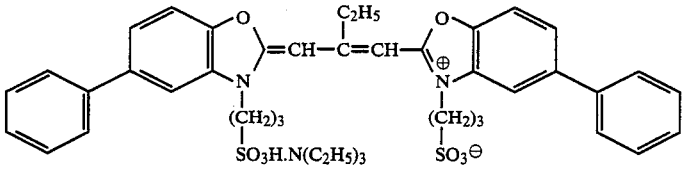
D-14
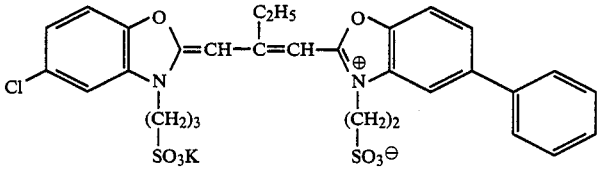
D-15
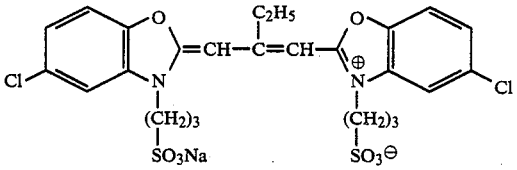
D-16
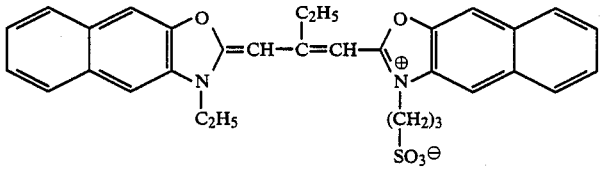
D-17
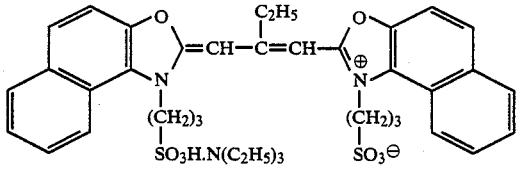
D-18
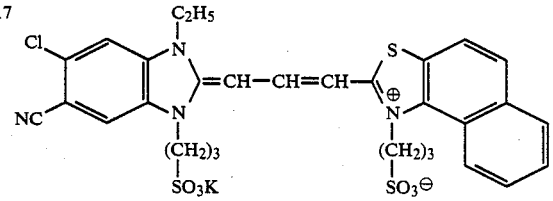

-continued
D-19
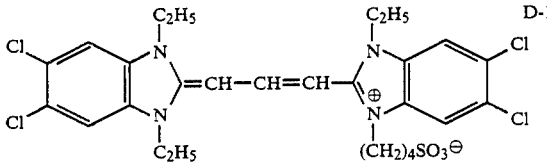
D-20
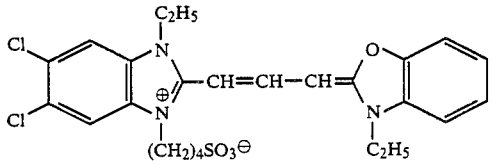
D-21
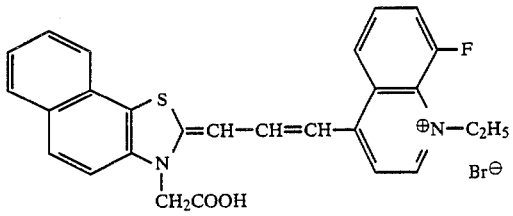
D-22
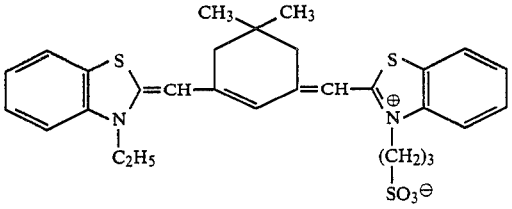
D-23
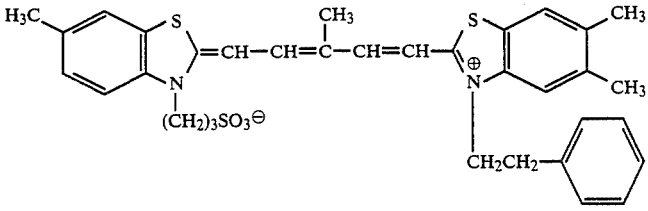
D-24
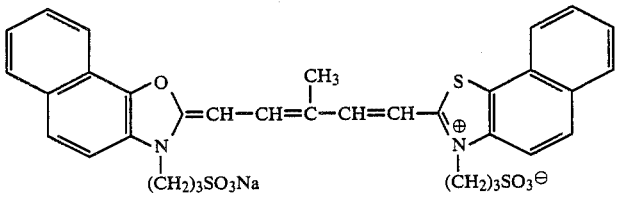
D-25
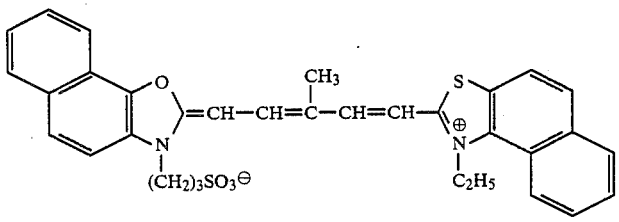
D-26
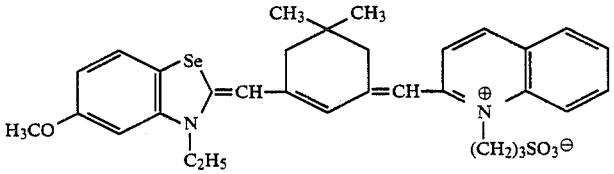
D-27
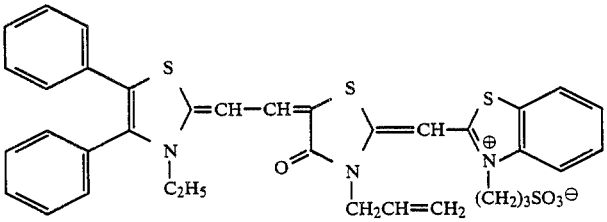

-continued
D-28
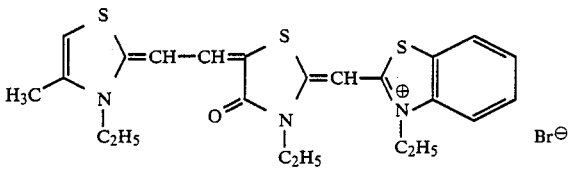
D-29
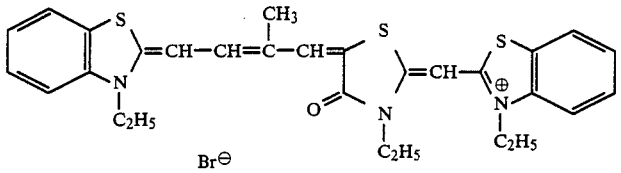
D-30
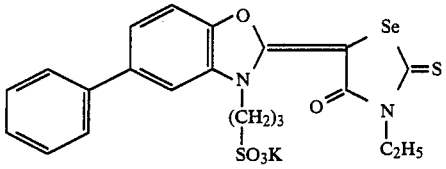
D-31
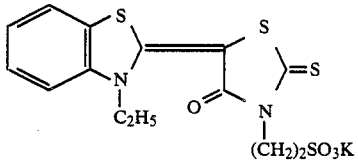
D-32
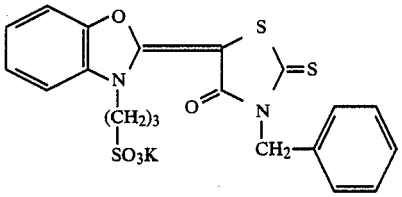
D-33
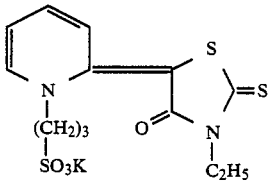
D-34
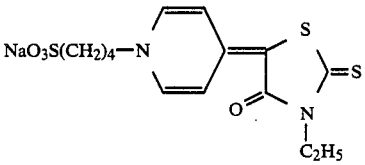
D-35
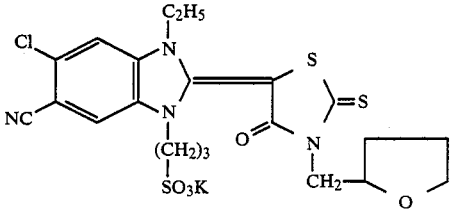
D-36
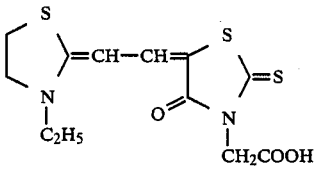
D-37
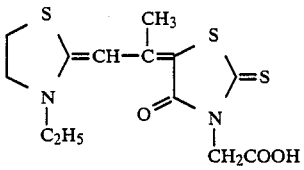
D-38
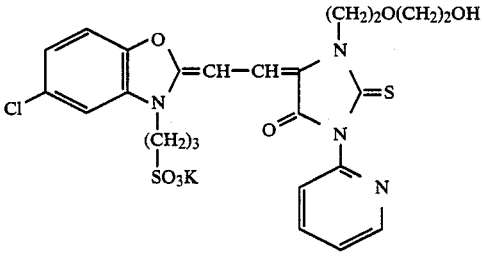
D-39
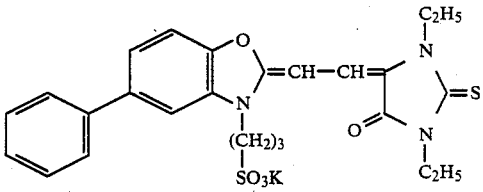
D-40
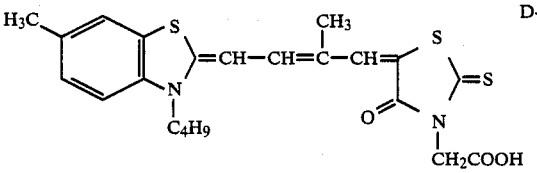
D-41
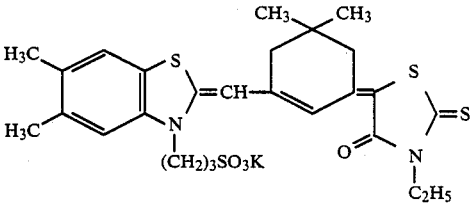

-continued

D-42

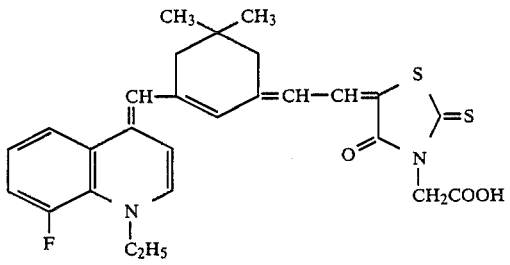

D-43

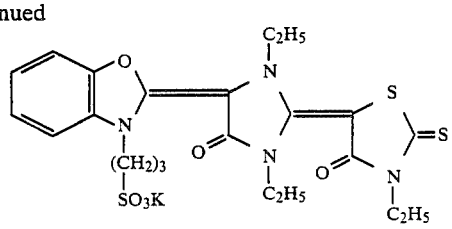

D-44

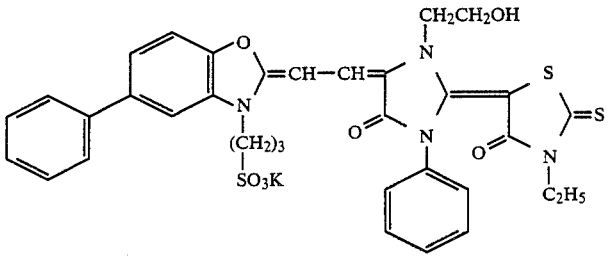

D-45

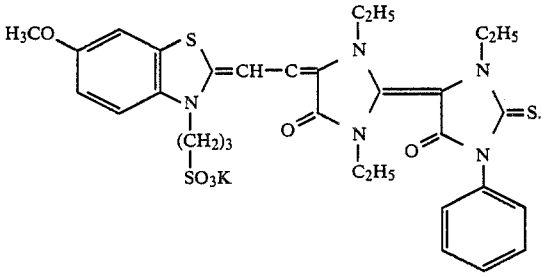

26. The method as claimed in claim 22, wherein said dye is a merocyanine dye represented by formula (I):

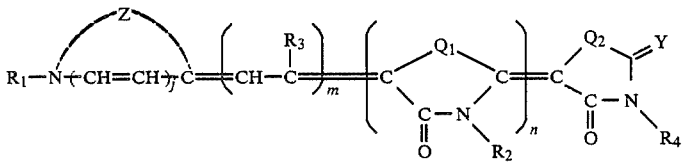

(I)

wherein

Z represents an atomic group necessary for forming a 5- or 6-membered heterocyclic ring;

$Q_1$ and $Q_2$ each represents a sulfur atom, a selenium atom, or a $>N—R_5$ group, wherein $R_5$ represents a substituted or unsubstituted alkyl group containing from 1 to 8 carbon atoms, and a monocyclic aryl group which may contain an oxygen atom, a sulfur atom or a nitrogen atom in the carbon chain and may be substituted by a hydroxyl group, a halogen atom, an alkylaminocarbonyl group, an alkoxycarbonyl group, a carbonyl group, or a phenyl group which may be further substituted;

Y represents a sulfur atom or a selenium atom;

$R_1$ represents a substituted or unsubstituted alkyl group containing 1 to 8 carbon atoms, a substituted or unsubstituted alkenyl group containing 1 to 8 carbon atoms, which may contain an oxygen atom and a sulfur atom in the carbon chain;

$R_2$ and $R_4$ each represents a substituted or unsubstituted alkyl group containing 1 to 8 carbon atoms, a substituted or unsubstituted alkenyl group containing 1 to 8 carbon atoms, which may contain an oxygen atom and a sulfur atom in the carbon chain, a hydrogen atom, or a substituted or unsubstituted monocyclic aryl group containing up to 8 carbon atoms; $R_3$ represents a hydrogen atom, a substituted or unsubstituted phenyl group containing up to 8 carbon atoms, or a substituted or unsubstituted alkyl group containing 1 to 6 carbon atoms;

j is 0 or 1;

m is 0, 1, 2 or 3;

n is 0 or 1; provided that when m is 2 or 3, the plural $R_3$ groups may be linked to form a 5- or 6-membered ring; and further provided that at most one of $R_1$, $R_2$ and $R_4$ contains a sulfo group.

27. The method as claimed in claim 19, wherein said chemically sensitizing step comprises sulfur sensitization, selenium sensitization, reduction sensitization or noble metal sensitization.

* * * * *